United States Patent [19]

Saxby

[11] Patent Number: 4,737,319

[45] Date of Patent: Apr. 12, 1988

[54] CARBURETOR FUEL BOWL ASSEMBLY

[75] Inventor: Richard M. Saxby, Detroit, Mich.

[73] Assignee: Colt Industries Inc, New York, N.Y.

[21] Appl. No.: 940,680

[22] Filed: Dec. 11, 1986

[51] Int. Cl.[4] ..... F02M 5/12

[52] U.S. Cl. ..... 261/34.1; 261/72.1; 261/70

[58] Field of Search ..... 261/34.1, 34.2, 72.1, 261/70

[56] References Cited

U.S. PATENT DOCUMENTS

| | | | |
|---|---|---|---|
| 2,768,819 | 10/1956 | Bodine, Jr. | 261/72.1 |
| 2,892,622 | 6/1959 | Goodyear | 261/72.1 |
| 3,058,728 | 10/1962 | Ruth | 261/72.1 |
| 3,138,646 | 6/1964 | Miles, Jr. et al. | 261/72.1 |
| 3,904,712 | 9/1975 | Taylor | 261/72.1 |
| 4,518,540 | 5/1985 | Takayasu | 261/34.1 |
| 4,556,032 | 12/1985 | Miller | 261/34.1 |

*Primary Examiner*—Tim Miles

*Attorney, Agent, or Firm*—Walter Potoroka, Sr.

[57] ABSTRACT

An improved fuel bowl assembly adapted to be detachably mounted upon a main carburetor body minimizes exposure of sealing gaskets to standing heads of fuel contained in the bowl and affords ready access to the interior of the bowl without risk of fuel spillage. A one piece housing is formed with a bathtub-like fuel bowl chamber whose open top is closed by a detachable cover. The front wall of the housing is provided with fuel and air bleed passages so arranged that fuel flowing from the bowl through these passages must rise above the normal level of fuel maintained in the bowl before exposure to the gasket which seals the front surface of the front wall of the housing to the side of the main carburetor body. A float valve mounted on the bottom side of the cover controls the flow of fuel from an inlet passage in the cover to maintain a desired level of fuel in the bowl, and the moving parts of an accelerating pump are also mounted on the cover. Thus, removal of the cover provides complete access to the float valve, accelerating pump and the interior of the bowl without requiring detaching the bowl assembly from the main carburetor body.

18 Claims, 3 Drawing Sheets

CARBURETOR FUEL BOWL ASSEMBLY

BACKGROUND OF THE INVENTION

The present invention is especially directed to carburetors having carburetor fuel bowl assemblies which are separable from the main carburetor body. Typically, fuel bowl assemblies of this type are employed in multi-barrel carburetors.

U.S. Pat. No. 2,892,622 discloses a typical commercially available multi-barrel carburetor in which a metering body or block is sandwiched between a fuel bowl and the main carburetor body. The fuel bowl is essentially a five sided box having a rear wall, top and bottom walls, and opposed side walls integral with each other. When assembled onto the carburetor, the open front of the fuel bowl is closed by the metering block which is sealed by a gasket to the front surface of the fuel bowl to define an enclosed fuel bowl chamber. This assembly is mounted upon a side wall of the main carburetor main body with a second gasket engaged between the front side of the metering block and the carburetor body.

It is advantageous to make the metering block and fuel bowl as units which are detachably mounted on the main carburetor body both from the standpoint of manufacturing convenience and convenience in servicing.

While carburetor assemblies of the type shown in U.S. Pat. No. 2,892,622 have given satisfactory service for many years, the structural arrangement is not without certain drawbacks. Access to the interior of the fuel bowl or to the rear side of the metering block requires the separation of the fuel bowl from the metering block, and this separation inherently dumps any fuel remaining in the fuel bowl as soon as the seal between the bowl and metering block is broken. The problem of difficulty of access to the interior of the fuel bowl chamber complicates the procedures employed to adjust the float or fuel level.

The present invention is especially concerned with a fuel bowl assembly which enables full access to the interior of the fuel bowl and the metering block with no risk of fuel spillage and in which the exposure of gaskets to static fuel heads is minimized.

SUMMARY OF THE INVENTION

In accordance with the present invention, a unitary metering block-fuel bowl assembly is constructed with the metering block constituting the front wall of an open top fuel bowl housing conformed to define a fuel bowl chamber at the rear side of the metering block. A detachable cover is mounted on the bowl housing to close the top of the fuel bowl chamber and a fuel inlet passage through the cover opens into a chamber via a float controlled inlet valve. The valve float is pivotally mounted upon the underside of the cover so that removal of the cover brings with the cover the float and valve as a unit. Vertically extending main fuel wells are formed in the metering block and communicate at their lower ends with inlet ports opening into the bottom of the fuel bowl chamber. Main fuel outlet ports open from the front surface of the metering block and communicate with the upper end of the main fuel well at a location above the normal fuel level within the bowl chamber established by the float valve. Idle passages also extend vertically within the metering block and communicate at their lower ends with the lower end of an adjacent main fuel well. The idle passages extend upwardly through the metering block to an upper end, again located above the normal fuel level of the bowl chamber, and then pass downwardly along the front side of the metering block to communicate with an idle port. The main fuel ports and idle ports are located to register with corresponding ports in the main carburetor body when the housing is mounted upon the carburetor body.

The fuel bowl housing may be formed with a hollow tubular open topped accelerating pump chamber formed integrally as a portion of the fuel bowl housing. The detachable cover is formed at its inner side with a tubular guide which slidably receives the rod of the accelerating pump piston slidably received within the pump chamber. A crank arm pivotally mounted in the cover is employed to drive the accelerating piston downwardly against the action of a return spring seated in the bottom of the accelerating pump chamber. Slots in the pump chamber wall extending below the normal level of fuel in the bowl define an inlet to the pump chamber, while a passage extending through the bottom wall and metering block to a discharge port at the front of the metering block at or above the normal fuel level provides an outlet to the accelerating pump. All parts of the accelerating pump are thus accessible upon removal of the cover from the housing.

Other objects and features of the invention will become apparent by reference to the following specification and to the drawings.

IN THE DRAWINGS

Figure 1:
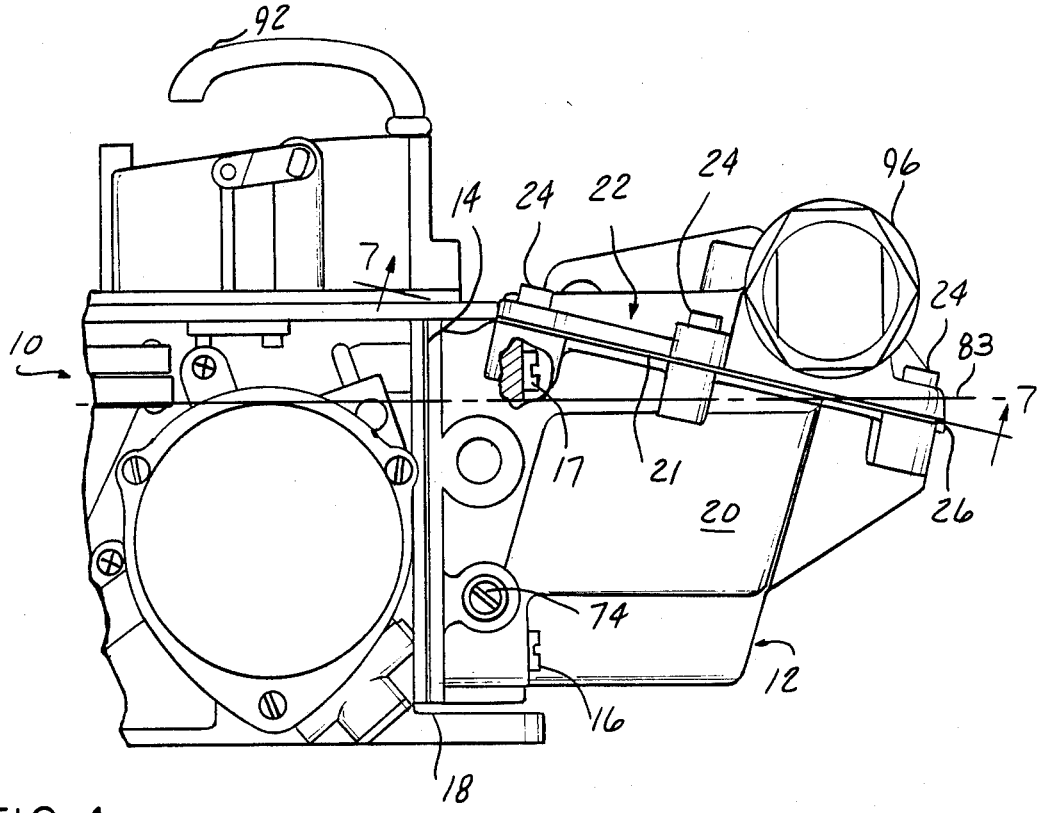
FIG. 1 is a partial side view of a carburetor having a fuel bowl assembly embodying the present invention.
Figure 2:
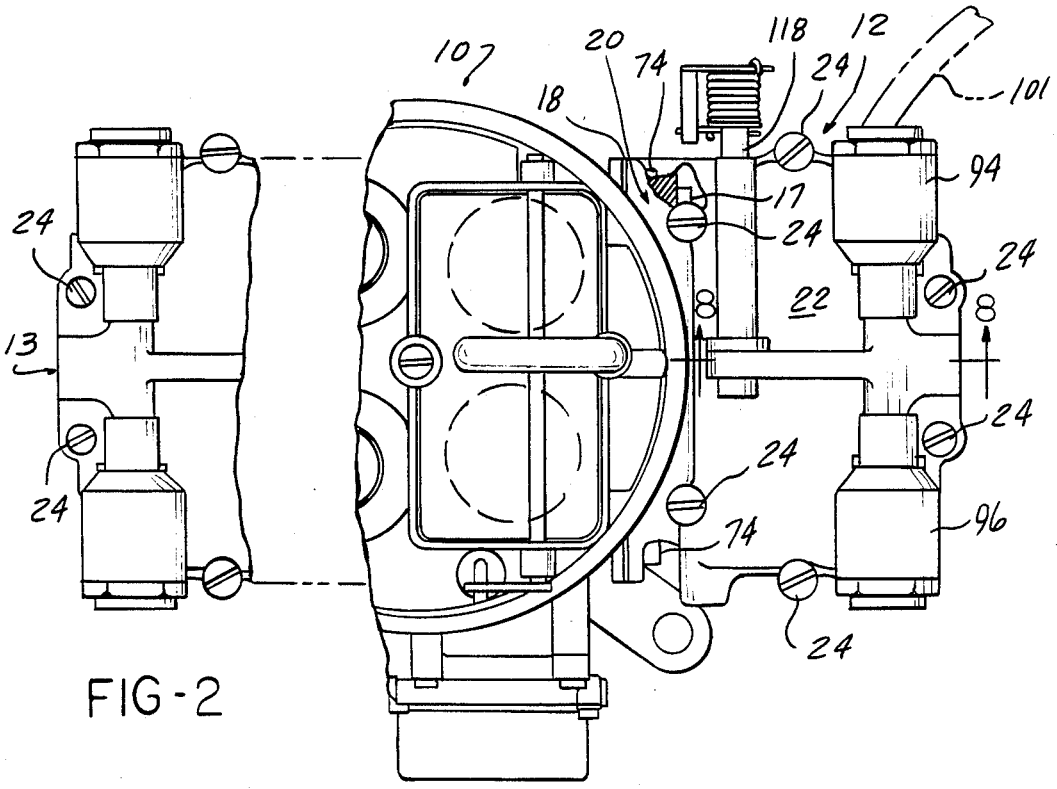
FIG. 2 is a partial top plan view of the carburetor and fuel bowl of FIG. 1.

FIGS. 1 and 2 are side and top views of approximately one half of a carburetor employing a fuel bowl assembly embodying the present invention. The carburetor includes a main body designated generally 10 having a fuel bowl assembly designated generally 12 detachably mounted in sealed face-to-face engagement with a vertical side surface 14 of the main carburetor body 10 by suitably disposed mounting bolts such as bolts 16 and 17. A gasket 18 is sealingly clamped between the opposed surfaces of the fuel bowl assembly and main carburetor body.

The main carburetor body 10 is of a standard commercial construction and may take the form of that employed in a two or a four barrel carburetor manufactured and sold by Holley Carburetor Division of Colt Industries as model number 2300 and 4150 respectively. The construction and operation of the Holley model 2300 and 4157 carburetors are well known in that thess carburetors have been widely employed in automotive and other applications for many years.

The present invention is directed to an improved fuel bowl assembly 12 designed to replace fuel bowl assemblies of the type shown in U.S. Pat. No. 2,892,622, either in the carburetor as originally manufactured or as a retrofit. The carburetor body 10 as shown in FIGS. 1 and 2 of the drawings is a four barrel carburetor and the fuel bowl 12 in the particular embodiment illustrated functions as the primary fuel bowl. A secondary fuel bowl 13 will be employed on the opposite side of carburetor body 10 and will be of a construction similar to that of fuel bowl assembly 12 except that various operative features of the primary fuel bowl, such as an accelerator pump, etc. may be omitted from the secondary fuel bowl assembly. Of course, in a two barrel carburetor, the secondary fuel bowl 13 is not required.

Fuel bowl assembly 12 includes two major elements which are a one piece housing designated generally 20 and a cover 22 detachably mounted on the top of housing 20 as by mounting bolts 24 (FIGS. 1 and 2). A gasket 26 is sealingly clamped between the cover and housing.

Referring now particularly to FIGS. 3–6 and 8, fuel bowl housing 20 is a one piece casting formed with a front wall 28, bottom wall 30, opposed side walls 32 and 34 and a rear wall 36 which cooperatively define an open topped bathtub-like fuel bowl chamber. Front wall 28 of housing 20 is relatively thick as compared to the remaining housing walls and is formed with a plurality of passages, described in greater detail below, through which fuel is conducted from the fuel bowl chamber to various ports opening at the front side of front wall 28 which register with corresponding ports formed on main carburetor body 10 (not shown) and in gasket 18 when the fuel bowl assembly 12 is mounted on main body 10.

Since the fuel bowl construction disclosed herein is intended for use in both original carburetor manufacture and retrofit of in use carburetors, it was desirable (a) to maintain, insofar as possible, the size and shape of the new fuel bowl housing 20, relative to the prior art separate metering block and fuel bowl elements it was designed to replace and (b) to retain the original location of the assembly retention means (the two lower screws 16 and two upper srews 17) to enable direct replacement of the separate prior art elements either at the original build point or to retrofit units already in service.

It was then found that, in order to utilize the two upper screw locations, they needed to be accessed inside the bowl, thus necessitating that the flange or walls at the bowl opening be inclined (see FIGS. 1 and 8) at a downward angle away from the front wall metering portion of the fuel bowl 20. This provided the required access for screw driver heads to the upper assembly screws 17 before the bowl conver casing 22 is fitted in place.

Figure 3:
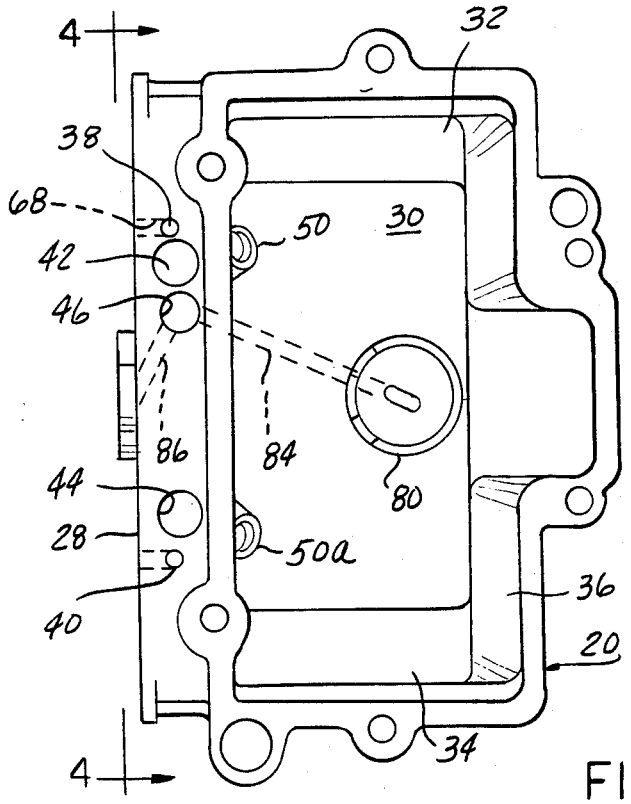
FIG. 3 is a top plan view of the fuel bowl of FIG. 1 separated from the main carburetor body with the fuel bowl cover removed.
Figure 4:
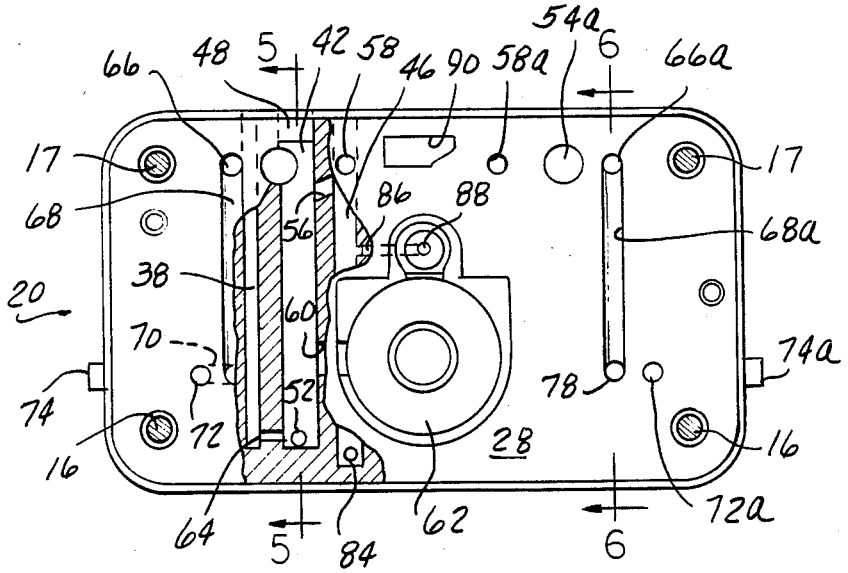
FIG. 4 is a front view of the fuel bowl, with a portion thereof cut away and in cross section, taken on the plane of line 4—4 of FIG. 3.
Figure 5:
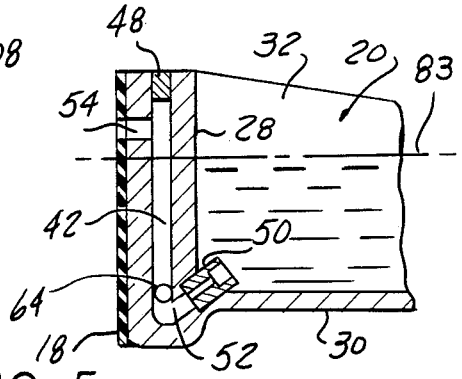
FIG. 5 is a partial schematic cross-sectional view of one of the main fuel passages of the fuel bowl taken on the plane of line 5—5 of FIG. 4.
Figure 6:
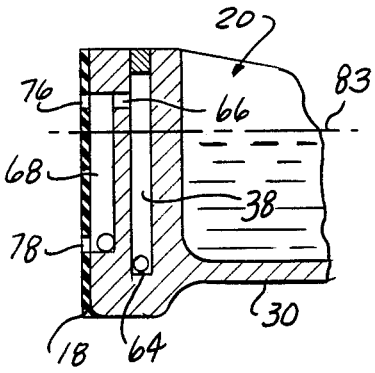
FIG. 6 is a partial schematic cross-sectional view illustrating certain portions of an idle fuel passage of the fuel bowl taken on the plane of line 6—6 of FIG. 4.

Referring now particularly to FIGS. 3–6, as best seen in FIG. 3 during the casting of housing 20, various vertical wells 38, 40, 42, 44, and 46 are formed by cores in the housing mold to extend downwardly from the top of front wall 28 to locations adjacent to, but spaced above, the bottom of wall 28 as best seen in FIGS. 4–6. Wells 38 and 40 function as idle fuel wells, wells 42 and 44 function as main fuel wells and well 46 functions as an accelerating pump fuel well. The open tops of these various wells are plugged in a manner similar to that shown by the plug 48 in well 42 in FIG. 4. Cross connections between the various wells and ports are established by drilling through front wall 28 to form passages between the wells and various ports, these latter bores being plugged where appropriate. These bores are frequently at odd angles and the cross-sectional views of FIGS. 5 and 6 which show schematically the main and idle fuel passages through front wall 28 are not true single plane cross-sections, but are schematically correct as far as the illustration of the flow passage is concerned.

Referring to FIG. 5, the bottom of main fuel well 42 communicates with the fuel bowl chamber via a main jet 50 mounted in housing 20 at the juncture of front wall 28 and bottom wall 30 to communicate with an inlet passage 52 communicating with the bottom of well 42. Near the upper end of well 42, a main fuel passage 54 extends from well 42 through the front face of front wall 28 to a mating hole in gasket 18 which, when the housing is assembled upon main carburetor body 10 will register with a main fuel passage in the main body 10. Referring to FIG. 4, a main well air bleed 56 also extends from main well 42 to an opening 58 in the front surface of front wall 28. Still another passage 60 (FIG. 4) extends from main well 42 through front wall 28 to communicate with a power valve 62 of well known construction sealingly mounted within a bore through front wall 28. Power valve 62, when the fuel bowl assembly is mounted upon the main carburetor body is exposed via the main carburetor body to manifold vacuum to supply additional fuel from the fuel bowl to main well 42 via passage 60 in accordance with engine speed requirements.

The various passages, etc. just described in association with the main fuel well 42 are duplicated in association with the other main fuel well 44, each of the fuel wells 42, 44 functioning to supply one of the two adjacent primary barrels in main carburetor body 10. Thus, fuel well 44 has an inlet defined by a main jet **50*a* (FIG. 3) an elevated outlet passage 54*a* and a main air bleed inlet 58*a* (FIG. 4) and communicates with power valve 62 in the same fashion as described in connection with well 42**.

Referring now to FIG. 6, idle well 38 may communicate at its lower end with the adjacent main fuel well 42 via a passage 64 (see also, FIG. 4). Near its upper end, idle well 38 communicates via a cross passage 66 with the top of a vertical groove 68 formed in the front face of front wall 28. Groove 68 extends downwardly across the front face of front wall 28 to a cross passage 70 which communicates with a forwardly opening idle fuel passage 72. An idle adjustment screw 74 threadably received in front wall 28 controls, in any well known manner, the flow of a fuel air mixture through cross passage 70. As best seen in FIG. 6, the front of groove 68 is primarily covered by gasket 18 so that when assembled onto the carburetor, an idle fuel passage is defined by the gasket and groove 68. An opening 76 through gasket 18 constitutes an idle air bleed into the top of groove 68 communicating with a corresponding passage, not shown, in the main carburetor body 10. A second opening 78 through gasket 18 at the bottom of groove 68 constitutes the idle constant feed port while the bore 70 (FIG. 4) is the metered idle discharge controlled by the idle adjustment screw 74.

Again, the various idle fuel passages, etc. associated with idle fuel well 38 are duplicated in connection with idle fuel well 40, and reference numerals with the subscript a designate corresponding elements.

Figure 8:
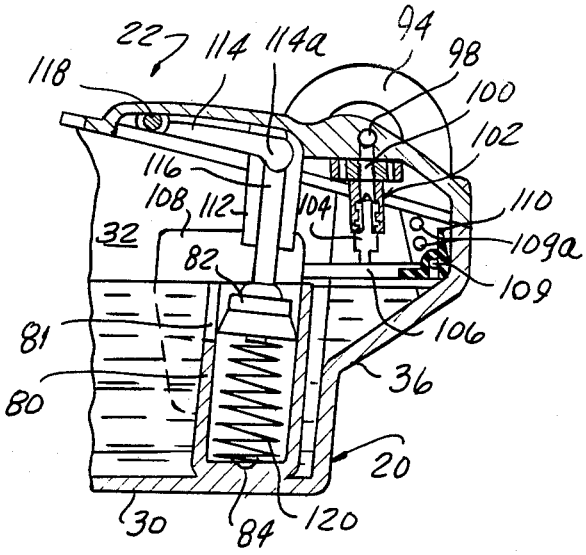
FIG. 8 is a detailed cross-sectional view taken on line 8—8 of FIG. 2.

Referring now particularly to FIGS. 3 and 8, main housing 20 is formed with an upwardly projecting hollow tubular accelerating pump chamber 80 which, as best seen in FIG. 8 slidably receives an accelerating pump piston 82 which will be described in greater detail below. Slots 81 in the wall chamber 80 extend downwardly from the top of the chamber to a location below the normal level of fuel shown by broken line 83 and below the upper limit of movement of piston 82 so that chamber 80 is normally filled with fuel at level 83.

Fluid communication between accelerating pump chamber 80 and well 46 is established by a passage 84 (FIG. 3) which passes from the bottom of well 46 through bottom wall 30 to open into the bottom of chamber 80. A cross passage 86 in front wall 28 extends from well 46 to a discharge nozzle 88 adapted to sealingly mate with a fitting on main carburetor 10 when the bowl is assembled to the main carburetor body.

A main vent passage 90 (FIG. 4) extends through front wall 28 of the bowl assembly to communicate with vent tube 92 (FIG. 1) opening into the air horn to vent the head space within the fuel bowl when cover 22 is in place and the assembly is mounted on the main carburetor body.

Referring now particularly to FIGS. 1, 2, 7 and 8, cover 22 may be formed with right and left fuel inlet fittings 94, 96 for coupling a fuel supply hose to the fuel bowl. A fuel inlet passage 98 (FIG. 8) extends through cover 22 to place both fittings 94, 96 in communication with a centrally located fuel inlet passage 100. A fuel supply hose, shown by broken lines 101, is connected to one of fittings 94, 96, depending upon which of the two fittings is most convenient, and the other fitting is plugged.

Fuel inlet passage 100 opens into the fuel bowl chamber, as best seen in FIG. 8, through a float controlled needle valve designated generally 102 of well known construction. The vertically movable needle 104 of valve 102 rests upon an arm 106 of a float 108 located in the fuel bowl chamber. The right hand end of arm 106, and viewed in FIG. 8, is pivotally supported by a pin 109 received in a selected set of bores **109*a* on brackets 110 integrally formed with and projecting downwardly from the bottom of cover 22. Float 108 moves upwardly and downwardly in response to variations in the level of fuel in the bowl chamber and this upward and downward movement of the float closes and opens valve 102 to establish a substantially constant level 83** of fuel in the fuel bowl chamber.

Figure 7:
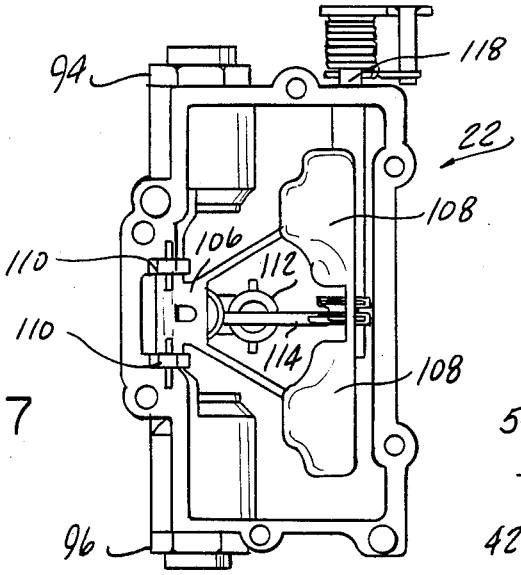
FIG. 7 is a bottom plan view of the fuel bowl cover as seen from line 7—7 of FIG. 1.

As best seen in FIG. 7, float 108 is formed in two spaced portions to clear a downwardly projecting tubular accelerating pump piston guide 112 integrally formed on the bottom of cover 22.

Guide 112 is slotted to slidably receive a crank arm 114 whose distal end **114*a* rests upon the top of the piston rod 116 of the accelerating pump piston 82 as best seen in FIG. 8. Crank 114 is rigidly connected at its opposite end to an actuating shaft 118 rotatably jouranlled within a bore in cover 22 and projecting from one side of the cover, as best seen in FIGS. 2 and 7 to be coupled to an external actuating linkage (not shown). Piston rod 116 is biased upwardly against crank 114 by a spring 120 (FIG. 8) engaged between pump piston 82 and the bottom of pump chamber 80**.

The fuel bowl assembly described above presents several advantages over prior art detachable fuel bowl-metering block assemblies such as that disclosed in U.S. Pat. No. 2,892,622.

By forming the fuel bowl housing as a bathtub-like fuel bowl chamber, the supply of fuel within the bowl has no direct contact with a sealing gasket such as gasket 18, and, in normal operation of the carburetor, fuel can leave the fuel bowl chamber only if it is aspirated through a vertical passage to a level above the normal level 83 of fuel in the chamber. The sole exception to this statement is the accelerating pump passage whose outlet from the chamber is through a port 88 located approximately at the normal fuel level 83. However, the connection between the accelerating pump outlet port 88 on the fuel bowl and its mating port in the main carburetor body may be through a mating male-female nipple which tightly is sealed by an o-ring.

Only a single gasket 18 is required to seal the detachable fuel bowl assembly to the main carburetor body, and the only static fuel head this gasket is exposed to when the carburetor is not in operation is that of the miniscule amount of fuel remaining in the vertical grooves 68 of the idle fuel passage.

Complete access to the interior of the bowl is had by removing the detachable cover 20. This can be accomplished, as in carburetor service, without fuel spillage while the carburetor remains mounted on the engine and the fuel bowl housing remains mounted on the carburetor body 10. The gasket 21 which seals this cover to housing 20 is well above the normal level of fuel within the chamber and not subject to a static fuel head.

Removal of the cover 22 brings with the cover the entire float valve assembly and provides complete access to all elements of the float valve assembly for service replacement or adjustment. Removal of the cover also affords complete access to all parts of the accelerating pump.

The accelerating pump is entirely contained within the bowl chamber, does not require a sealing gasket and does not rely upon a pump diaphragm to seal the pump against leakage.

While one embodiment of the invention has been described in detail, it will be apparent to those skilled in the art the disclosed embodiment may be modified. Just for example, the specific configuration of the walls in the front wall of the fuel bowl and the various fuel and other passages between the fuel bowl and the carburetor main body may be modified as desired, one of the main features and objects of the invention being the unitary or one-piece fuel bowl/milling block and fuel bowl cover assembly wherein the fuel passages between the fuel bowl as the carburetor main body have substantially no contact with sealing gaskets at a point below the fuel level in the fuel bowl. Therefore, the foregoing description is to be considered exemplary rather than limiting, and the true scope of the invention is that defined in the following claims.

I claim:

1. A carburetor comprising a carburetor main body having a side wall, fuel bowl means including means defining an enclosed chamber and means for maintaining a supply of fuel at a predetermined normal level within said chamber, a gasket lying against said side wall, means detachably mounting said fuel bowl means on said main body with said gasket sealingly clamped therebetween and fuel passage means extending from said chamber into said main body via an opening through said gasket, said fuel passage means including a passage section in said fuel bowl means at an elevation above said normal level to isolate said gasket from the static head of fuel within said chamber, said fuel bowl chamber being an open-top, bath tub like chamber defined by a bottom wall, a front wall disposed adjacent said gasket and main body side wall and having mounting portions exterior of said bowl, a rear wall having a height above said bottom wall less than the height of said front wall above said bottom wall and a pair of opposed side walls at the ends of said front and rear walls, said side walls sloping in height above said bottom wall from said front wall height to said rear wall height, the upper edges of said front, rear and side walls forming a flange lying in a plane inclined at a downward angle away from said front wall, and a bowl cover removably mounted on said flange, said detachable mounting means comprising a first pair of mounting bolts passing through said front wall mounting portions and threadably received in said main body, so that the bolt heads are accessible from the exterior of said fuel bowl, and a second pair of mounting bolts passing through said front wall adjacent to and below the top of said front wall and threadably received in said main body, the heads of said second pair of bolts being located within said bowl and below said cover at a level above the top of said rear wall.

2. The invention defined in claim 1 further comprising means defining an open topped accelerator pump chamber projecting upwardly from said bottom wall in the interior of said bowl, first passage means extending through said bottom and front wall of said bowl from the bottom of said chamber to a first outlet port, means establishing fluid communication between said first outlet port and a first fuel passage in said main body, an accelerator pump piston slidably received in said pump chamber, and means on said cover for driving said piston within said chamber.

3. The invention defined in claim 1 further comprising means defining an open topped hollow tubular member integrally formed on said housing projecting upwardly from the bottom of said chamber to define an accelerating pump chamber within said fuel containing chamber, an accelerating pump piston slidably received in said pump chamber and including a piston rod projecting upwardly from said pump chamber, spring means biassing said piston upwardly within said chamber, first means integrally formed on the underside of said cover for slidably receiving and guiding said piston rod, and second means mounted on said cover for driving said piston rod and piston downwardly against the biassing action of said spring means.

4. The invention defined in claim 1 wherein said fuel supply means comprises a fuel hose fitting on said cover for operatively coupling a fuel supply hose to said cover, fuel inlet passage means in said cover extending through said cover from said fitting to a discharge opening in the bottom side of said cover opening into said fuel chamber, vertically movable needle valve means operatively mounted in said discharge opening movable between an open and a closed position to selectively permit or prevent the flow of fuel from said inlet passage means into said fuel chamber, bracket means integrally formed on said cover and projecting downwardly from the bottom side of said cover adjacent said discharge opening, a float mounted on said bracket means for vertical movement relative to said cover in response to variations in the level of fuel within said fuel chamber, and means on said float engaged with said needle valve means for moving said needle valve means vertically in response to vertical movement of said float relative to said cover.

5. The invention defined in claim 1 wherein said cover comprises first means mounted on the bottom side of said cover for monitoring the level of fuel within said chamber, and second means mounted on said cover operable to increase the rate of flow of fuel from said chamber.

6. The invention defined in claim 5 wherein said second means comprises an actuating member mounted for movement in said cover and having a first end projecting externally from said cover and a second end projecting into said chamber when said cover is mounted on said housing, and accelerating pump means in said chamber engaged by said second end of said actuating member.

7. A carburetor comprising a carburetor main body having a side with at least one fuel passage opening therein and a fuel bowl assembly detachably mounted upon said side of said main body, said fuel bowl assembly comprising a housing including a front wall, means for detachably mounting said front wall upon said side of said carburetor main body, said front wall having a forward side, a rearward side, and at least one fuel passage therethrough terminating at said fuel passage opening in the forward side of said front wall located to be in registry with said fuel passage opening in said side of said carburetor body when said bowl assembly is mounted on said body, said housing including wall means integral with said front wall defining a bath tub-like fuel chamber at the rearward side of said front wall, said chamber having an open top, a cover detachably mounted on said housing to close said open top of said chamber, a fuel supply means on said cover for regulating the flow of fuel into said chamber to maintain a generally constant normal level of fuel within said chamber, and flow passage means in said housing establishing fluid communication between the bottom of said chamber and said fuel passage in said front wall, said fuel passage in said front wall having a vertical section therein extending upwardly from said flow passage means to a location above said normal level of fluid within said chamber whereby fuel flowing from said chamber to said outlet opening must rise above said normal level, said fuel bowl housing being defined by a bottom wall, said front wall, a rear wall having a height less than the height of said front wall and a pair of opposed side walls at the ends of said front and rear walls, the upper edges of said front, rear and side walls forming a flange lying in a plane inclined at a downward angle away from said front wall, said cover being removably mounted on said flange, said detachable fastening means comprising a first pair of mounting bolts passing through portions of said front wall below said bottom wall and threadably received in said main body, and a second pair of bolts having bolt heads located within said bowl and below said cover at a level above the top of said rear wall.

8. The invention defined in claim 7 further comprising means defining an open topped accelerator pump chamber projecting upwardly from said bottom wall in the interior of said bowl, first passage means extending through said bottom and front wall of said bowl from the bottom of said chamber to a first outlet port, means establishing fluid communication between said first outlet port and a first fuel passage in said main body, an accelerator pump piston slidably received in said pump chamber, and means on said cover for driving said piston within said chamber.

9. The invention defined in claim 7 further comprising means defining an open topped hollow tubular member integrally formed on said housing projecting upwardly from the bottom of said chamber to define an accelerating pump chamber within said fuel containing chamber, an accelerating pump piston slidably received in said pump chamber and including a piston rod projecting upwardly from said pump chamber, spring means biassing said piston upwardly within said chamber, first means integrally formed on the underside of said cover for slidably receiving and guiding said piston rod, and second means mounted on said cover for driving said piston rod and piston downwardly against the biassing action of said spring means.

10. The invention defined in claim wherein said fuel supply means comprises a fuel hose fitting on said cover for operatively coupling a fuel supply hose to said cover, fuel inlet passage means in said cover extending through said cover from said fitting to a discharge opening in the bottom side of said cover opening into said fuel chamber, vertically movable needle valve means operatively mounted in said discharge opening movable between an open and a closed position to selectively permit or prevent the flow of fuel from said inlet passage means into said fuel chamber, bracket means integrally formed on said cover and projecting downwardly from the bottom side of said cover adjacent said discharge opening, a float mounted on said bracket means for vertical movement relative to said cover in response to variations in the level of fuel within said fuel chamber, and means on said float engaged with said needle valve means for moving said needle valve means vertically in response to vertical movement of said float relative to said cover.

11. The invention defined in claim 7 wherein said cover comprises first means mounted on the bottom side of said cover for monitoring the level of fuel within said chamber, and second means mounted on said cover operable to increase the rate of flow of fuel from said chamber.

12. A fuel bowl assembly adapted to be detachably mounted upon a side of a carburetor body having at least one fuel passage, said fuel bowl assembly comprising a one-piece housing having a front wall adapted to be detachably mounted upon the side of said main carburetor body, said front wall having a forward side, a rearward side, and a fuel passage therethrough terminating at and the forward side of said front wall and located to be in registry with said fuel passage in said side of the carburetor body when said housing is mounted on said body, said housing including wall means integral with the rearward side of said front wall forming an open-topped, bath tub-like chamber defined by a bottom wall, said front wall, a rear wall having a height less than the height of said front wall and a pair of opposed side walls at the ends of said front and rear walls, the upper edges of said front, rear and side walls forming a flange lying in a plane inclined at a downward angle away from said front wall, and a cover overlying said front, rear and side walls of said bowl, detachable fastening means comprising a first pair of mounting bolts passing through portions of said front wall below said bottom wall and adapted to be threadably received in said main body, said first pair of bolts having bolt heads accessible from the exterior of said fuel bowl, and a second pair of mounting bolts passing through said front wall adjacent to and below the top of said front wall and adapted to be threadably received in said main body, said second pair of bolts having bolt heads located within said bowl and below said cover at a level above the top of said rear wall, fuel supply means on said cover for regulating the flow of fuel into said chamber to maintain a generally constant normal level of fuel within said chamber, and flow passage means in said housing establishing fluid communication between the bottom of said chamber and said fuel passage in said front wall, said fuel passage in said front wall having a vertical section therein extending upwardly to a location above said normal level of fluid within said chamber whereby fluid flowing from said chamber to said outlet openings must rise above said normal level.

13. The invention defined in claim 12 further comprising means defining an open topped hollow tubular member integrally formed on said housing projecting upwardly from the bottom of said chamber to define an accelerating pump chamber within said fuel containing chamber, an accelerating pump piston slidably received in said pump chamber and including a piston rod projecting upwardly from said pump chamber, spring means biassing said piston upwardly within said chamber, first means integrally formed on the underside of said cover for slidably receiving and guiding said piston rod, and second means mounted on said cover for driving said piston rod and piston downwardly against the biassing action of said spring means.

14. The invention defined in claim 12 wherein said fuel supply means comprises a fuel hose fitting on said cover for operatively coupling a fuel supply hose to said cover, fuel inlet passage means in said cover extending through said cover from said fitting to a discharge opening in the bottom side of said cover opening into said fuel chamber, vertically movable needle valve means operatively mounted in said discharge opening movable between an open and a closed position to selectively permit or prevent the flow of fuel from said inlet passage means into said fuel chamber, bracket means integrally formed on said cover and projecting downwardly from the bottom side of said cover adjacent said discharge opening, a float mounted on said bracket means for vertical movement relative to said cover in response to variations in the level of fuel within said fuel chamber, and means on said float engaged with said needle valve means for moving said needle valve means vertically in response to vertical movement of said float relative to said cover.

15. The invention defined in claim 12 wherein said cover comprises first means mounted on the bottom side of said cover for monitoring the level of fuel within said chamber, and second means mounted on said cover operable to increase the rate of flow of fuel from said chamber.

16. The invention defined in claim 15 wherein said second means comprises an actuating member mounted for movement in said cover and having a first end projecting externally from said cover and a second end projecting into said chamber when said cover is mounted on said housing, and accelerating pump means in said chamber engaged by said second end of said actuating member.

17. The invention defined in claim 12 further comprising means defining an open topped accelerator pump chamber projecting upwardly from said bottom wall in the interior of said bowl, first passage means extending through said bottom and front wall of said bowl from the bottom of said chamber to a first outlet port, means establishing fluid communication between said first outlet port and a first fuel passage in said main body, an accelerator pump piston slidably received in said pump chamber, and means on said cover for driving said piston within said chamber.

18. A direct replacement fuel bowl, for converting a carburetor having a bolted, side-mounted fuel bowl that must be removed for access to the bowl interior to a carburetor wherein access to the bowl interior does not require removal of the bowl, the replacement fuel bowl using the existing bolt holes and fuel metering portion, said fuel bowl comprising an open-top, bath tub-like container having a separate removable cover, said container being defined by connected walls including a bottom wall, a pair of opposed side walls, a front wall and a rear wall, said front wall having mounting bolt openings therein for registering with the carburetor bolt holes, some of said openings being disposed externally of said bowl and other of said openings being disposed within said bowl at a level above said rear wall, said front wall height being greater than said rear wall height and the top edges of said side walls sloping from said higher front wall to said lower rear wall, said top edges of said walls forming a cover mounting flange sloping downwardly away from said front wall, said cover being removably mountable on said flange.

* * * * *